US008098863B2

(12) United States Patent
Ho et al.

(10) Patent No.: US 8,098,863 B2
(45) Date of Patent: Jan. 17, 2012

(54) HEARING APPARATUS HAVING AN ELECTRICAL CONTROL ELEMENT INTEGRATED IN A COVER

(75) Inventors: Wai Kit David Ho, Singapore (SG); Wee Haw Koo, Singapore (SG); Beng Hai Tan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 1283 days.

(21) Appl. No.: 11/649,615

(22) Filed: Jan. 4, 2007

(65) Prior Publication Data

US 2007/0248234 A1 Oct. 25, 2007

(30) Foreign Application Priority Data

Jan. 13, 2006 (DE) ..... 10 2006 001 844

(51) Int. Cl.
*H04R 25/00* (2006.01)

(52) U.S. Cl. ..... 381/324; 381/312; 381/322; 381/323

(58) Field of Classification Search ..... 381/312–331
See application file for complete search history.

(56) References Cited

U.S. PATENT DOCUMENTS

| | | | | |
|---|---|---|---|---|
| 4,961,230 | A * | 10/1990 | Rising | 381/323 |
| 5,404,407 | A | 4/1995 | Weiss | |
| 2005/0157898 | A1 * | 7/2005 | Gabathuler | 381/322 |

FOREIGN PATENT DOCUMENTS

| | | | |
|---|---|---|---|
| CH | 667766 | A5 | 10/1988 |
| DE | 8800629 | U1 | 6/1989 |
| DE | 42 33 813 | C1 | 11/1993 |
| DE | 195 14 360 | C1 | 2/1996 |
| EP | 0341902 | A2 | 11/1989 |
| EP | 1435758 | A1 | 7/2004 |

* cited by examiner

*Primary Examiner* — Davetta W Goins
*Assistant Examiner* — Matthew Eason

(57) ABSTRACT

Hearing apparatuses and in particular hearing devices are to be designed smaller. To this end, provision is made to integrate an electrical control facility for controlling the hearing apparatus into the cover for covering a programming connection of the hearing apparatus. This multifunctionality of the cover allows installation space to be saved. It is particularly favorable if an actuating element of an electrical push button is mounted to the same bolt, to which the cover itself is also mounted.

8 Claims, 1 Drawing Sheet

HEARING APPARATUS HAVING AN ELECTRICAL CONTROL ELEMENT INTEGRATED IN A COVER

CROSS REFERENCE TO RELATED APPLICATIONS

This application claims priority of German application No. 10 2006 001 844.3 filed Jan. 13, 2006, which is incorporated by reference herein in its entirety.

FIELD OF THE INVENTION

The present invention relates to a hearing apparatus, in particular a hearing device, having a programming connection for connecting the hearing apparatus to a programming device and a cover for covering the programming connection.

BACKGROUND OF THE INVENTION

Hearing devices, headsets and other hearing apparatus can frequently be programmed with a programming device via a programming interface. A programming socket is thus generally provided on the part of the hearing apparatus, with which programming socket the programming device can be connected to the hearing apparatus by cable.

The contacts of a programming socket are relatively small and thus accordingly sensitive. Furthermore, it is expedient to protect the contacts of a programming socket against contamination and other environmental influences. On this account, a programming socket is generally covered with a casing.

The publication DE 195 14 360 C1 discloses a BTE hearing device (Behind-The-Ear hearing device), with which a compartment for accommodating the circuit element is provided in the banana-shaped curved external front wall of the hearing device frame for the simple assembly and re-fitting of a switch, in particular a situation converter. The switch element embodied as a flat component can be inserted into the drawer-like compartment and can be brought into contact with the connections of the amplifier circuit disposed in the frame's compartment using its electrical connections. The frame can be covered by a housing screen in the region of the circuit element, said housing screen comprising an attachment for an actuating element of the sensing head.

Furthermore, the publication DE 296 02 921 U1 describes a BTE hearing device comprising a banana-shaped housing accommodating the hearing device components, said housing featuring a pivoting flap on its convexly curved exterior surface. This flap forms a housing screen for at least one coverable hearing device component and simultaneously exhibits at least one attachment with a recess for a control element.

The patent application DE 42 33 813 C1 also discloses a programmable hearing aid device, with which a space-saving arrangement of the switch elements is achieved in that a programming socket, which is located on the housing of the hearing aid device, can also be used to accommodate at least one circuit element.

SUMMARY OF THE INVENTION

The object of the present invention consists in further reducing the size of a hearing apparatus and/or hearing device.

This object is achieved in accordance with the invention by a hearing apparatus, in particular a hearing device, having a programming connection for connecting the hearing apparatus to a programming device and a cover for covering the programming connection, with an electrical control facility for controlling the hearing apparatus being integrated in the cover.

Installation space is advantageously saved by integrating the electrical control facility into the cover, so that the hearing apparatus can be designed smaller overall.

The programming connection is preferably a programming socket. This enables a hearing apparatus with a standard connection to be designed in a more compact form.

According to a preferred embodiment, the hearing apparatus according to the invention can comprise a switch as an electrical control facility. In particular, this switch can be a push-button. As switches take up a relatively large surface on the hearing device, the inventive advantage is particularly useful in that surface taken up by the programming connection is used twice.

Alternatively or in addition, the electrical control facility can comprise an actuator. By way of example, this actuator can be used as a loudspeaker actuator or as a program actuator. Actuators of this type also generally require a considerable amount of surface area on the hearing device, so that when this actuator is integrated into the cover, a significant space saving can be achieved, as with a switch.

With a special form of embodiment, the cover of the programming connection can be mounted to the housing of the hearing apparatus in a pivotable fashion. It is particularly preferable here if the cover and the actuating element are mounted to the housing of the hearing apparatus by means of a mutual bearing element. In this case, the mutual bearing element can be a bolt. This multifunctionality of the bearing element also allows space and weight savings to be achieved.

Furthermore, the cover of the programming connection can comprise an insertion opening, into which can be inserted an electrical module of the control facility. An adequate fixing of the electronic part of the control facility can be realized in this way. It is favorable, in particular, if the bearing element, e.g. the bolt, protects the electronics module against unintentionally sliding out from the cover.

BRIEF DESCRIPTION OF THE DRAWINGS

The present application is now described in further detail below with reference to the appended drawings, in which.

DETAILED DESCRIPTION OF THE INVENTION

The exemplary embodiment shown in more detail below represents a preferred embodiment of the present invention.

Figure 1:
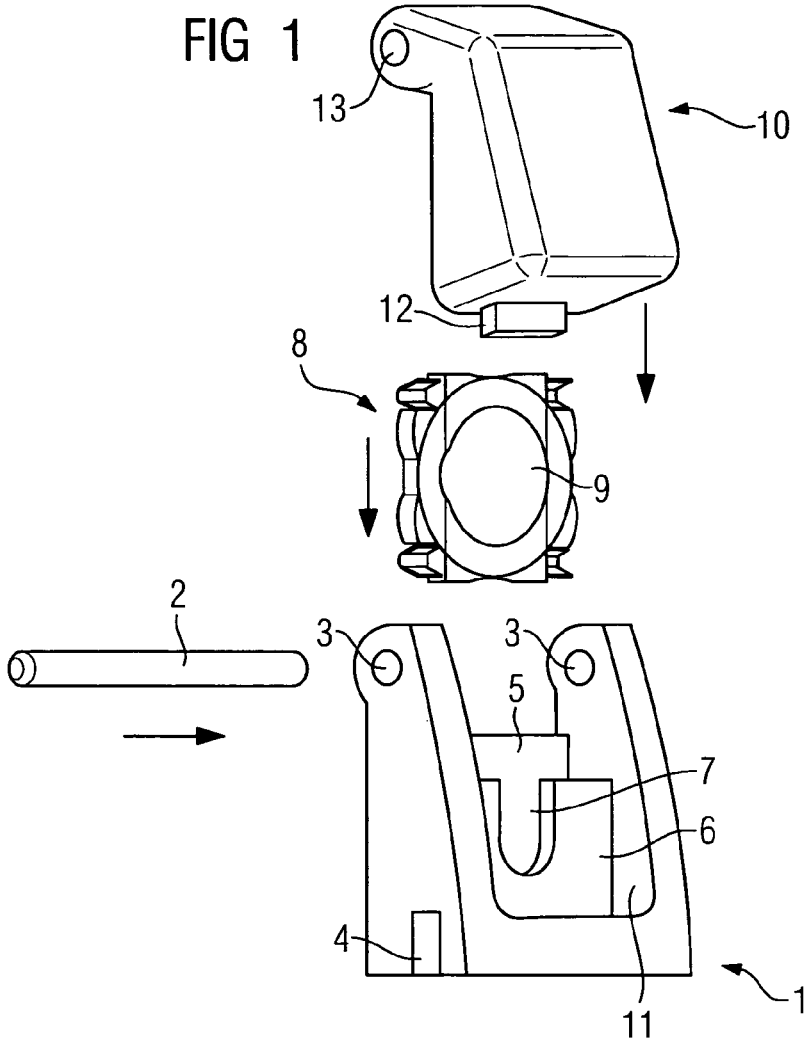
FIG. 1 shows an explosion view of an inventive cover with an integrated push-button and FIG. 2 shows the cover of FIG. 1 in an assembled state.

FIG. 1 shows a perspective view of a cover 1 of a programming socket of a hearing device (not shown). The cover 1 is mounted to a bearing bolt 2 in a pivotable fashion. Based on the image in FIG. 1, the programming socket then lies below the cover 1. So that the cover can be fixed into a cover state, it exhibits a groove 4 on the side opposing the bearing bores 3. A snap-on element of the hearing device housing can be detachably engaged in this groove 4.

Internally, the cover comprises a lower bar 5 and an upper bar 6. The upper bar 6 exhibits a U-shaped recess 7. The two plate-shaped bars 5 and 6 are distanced from one another such that a serially manufactured push-button module 8 can be inserted therebetween. This push-button module 8 features an actuating surface 9, which is accessible from above by way of the recess 7 of the cover 1. An electrical connection of the push-button module 8 to a PCB (Printed Circuit Board) is not shown in FIG. 1.

After the push-button module 8 is moved into the cover 1, the bearing bolt 2 can be inserted into the bearing bore 3. The bearing bolt 2 then prevents the push-button module 8 from unintentionally sliding out from the insertion opening, which is formed by the two bars 5 and 6. The bearing bolt 2 thus represents a back stop for the push-button module 8.

Before the bearing bolt 2 is however actually inserted into the bearing bore 3 of the cover 1, another actuating element 10 is placed in a corresponding recess 11 of the cover 1. The actuating element 10 exhibits a projection 12, which can be moved into the groove 4 extending to the recess in a vertical direction to a predetermined path. The actuating element 10 features a bearing bore 13 on the side facing the projection 12. When inserting the bearing bolt 2 into the bearing bore 3 of the cover 1, the bearing bolt 2 is thus simultaneously guided through the bearing bore 13 of the control element 10.

The actuating surface 9 of the push-button module 8 is designed to be elastic, so that the actuating element 10 is reset after actuation, i.e. after bearing down. To this end, the actuating element 10 exhibits a pen (not shown in FIG. 1), which presses on the actuating surface 9 of the push-button module 8 through the recess 7.

Figure 2:
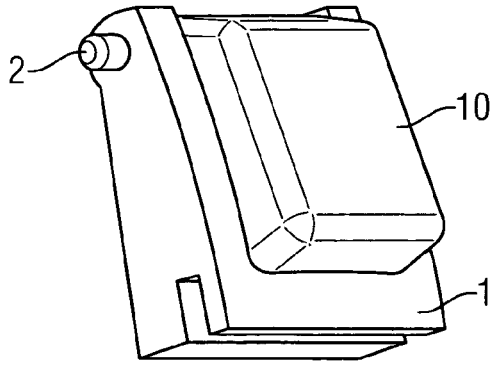

In a completely assembled state, the cover 1 exhibits the design reproduced in FIG. 2. The actuating element 10 can bear down on the bearing bolt 2 in a mounted state. The bearing bolt 2 juts out in its axial direction somewhat past the edge of the cover 1, so that it can be mounted into a corresponding recess or bore in a hearing device housing. The actuating element 10 is herewith mounted to the cover 1 with the aid of the bolt 2 and the cover itself likewise mounted to the hearing device housing with the aid of the bolt 2.

In the cover according to the invention, an integration of a range of functions is thus realized in a single component. In addition to the cover function, a switching or control function is also realized in the component. To this end, an actuator, e.g. a program actuator or a changeable resistor, is integrated into the cover if necessary instead of or in addition to the push-button.

This integration not only reduces the production time of the hearing apparatus, but also enables an increased automation of production. Furthermore, the overall installation space is saved and a module is provided by means of the multifunctional component, said module being able to be developed with different switches or actuators depending on the requirements.

The invention claimed is:

1. A hearing apparatus, comprising:

a programming connection that connects the hearing apparatus to a programming device;

a cover that covers the programming connection; and an electrical control unit of the hearing apparatus that is integrated in the cover to reduce a size of the hearing apparatus;

wherein the cover is pivotally mounted to a housing of the hearing apparatus with a mutual bearing element that is configured to pass through a bearing bore in the cover;

wherein an interior space of the cover includes an insertion opening to receive the electrical control unit, and wherein the mutual bearing element in the bearing bore of the cover is configured to prevent the electrical control unit from sliding out of the insertion opening of the cover;

wherein the cover comprises a lower bar and an upper bar, wherein the upper bar includes a U-shaped recess; and wherein the lower bar and the upper bar are spaced apart to receive the electrical control unit comprising a push-button module.

2. The hearing apparatus as claimed in claim 1, wherein the programming connection is a programming socket.

3. The hearing apparatus as claimed in claim 1, wherein the electrical control unit comprises an actuator.

4. The hearing apparatus as claimed in claim 3, wherein the actuator is a loudspeaker actuator or a program actuator.

5. The hearing apparatus as claimed in claim 1, wherein the mutual bearing element is a bolt.

6. The hearing apparatus as claimed in claim 1, wherein the hearing apparatus is a hearing device or a headset.

7. A method for reducing a size of a hearing apparatus, comprising:

connecting the hearing apparatus to a programming device via a programming connection;

covering the programming connection by a cover;

integrating an electrical control unit of the hearing apparatus in the cover so that the size of the hearing apparatus is reduced;

pivotally mounting the cover to a housing of the hearing apparatus with a mutual bearing element that is configured to pass through a bearing bore in the cover;

receiving the electrical control unit in an insertion opening of an interior space of the cover;

preventing the electrical control unit from sliding out of the insertion opening of the cover with the mutual bearing element in the bearing bore; and receiving the electrical control unit comprising a push-button module by spacing apart a lower bar and an upper bar of the cover, wherein the upper bar includes a U-shaped recess.

8. The hearing apparatus as claimed in claim 1, wherein the cover includes a groove on a side of the cover opposite to the bearing bore, wherein an actuating element is passed into an internal recess of the cover, and wherein a projection of the actuating element is received within the groove.

* * * * *